US006907823B2

(12) United States Patent
Gelbart

(10) Patent No.: US 6,907,823 B2
(45) Date of Patent: Jun. 21, 2005

(54) FLEXOGRAPHIC PRINTING ON CONTAINERS

(75) Inventor: Daniel Gelbart, Vancouver (CA)

(73) Assignee: Creo Inc., Burnaby (CA)

( * ) Notice: Subject to any disclaimer, the term of this patent is extended or adjusted under 35 U.S.C. 154(b) by 53 days.

(21) Appl. No.: 10/689,087

(22) Filed: Oct. 21, 2003

(65) Prior Publication Data

US 2005/0081725 A1 Apr. 21, 2005

(51) Int. Cl.[7] ..... B41F 17/08
(52) U.S. Cl. ..... 101/40.1; 101/37; 101/38.1
(58) Field of Search ..... 101/35–40.1

(56) References Cited

U.S. PATENT DOCUMENTS

| | | | |
|---|---|---|---|
| 3,405,633 | A | 10/1968 | Price, Jr. et al. |
| 3,564,998 | A | 2/1971 | Johnson et al. |
| 3,661,282 | A | 5/1972 | Buhayar et al. |
| 4,456,422 | A | 6/1984 | Swayze |
| 4,480,540 | A | 11/1984 | Lock et al. |
| 4,889,050 | A | 12/1989 | Meador |
| 5,193,456 | A | 3/1993 | Wolfe et al. |
| 5,333,720 | A | 8/1994 | Zwigart et al. |
| 5,467,864 | A | 11/1995 | McCoy et al. |
| 5,730,048 | A | 3/1998 | Averill et al. |
| 5,865,114 | A | 2/1999 | Averill et al. |
| 5,970,865 | A | 10/1999 | Horth et al. |
| 6,026,743 | A | 2/2000 | Kloti |

FOREIGN PATENT DOCUMENTS

WO WO 94/19192 A1 9/1994

*Primary Examiner*—Ren Yan
(74) *Attorney, Agent, or Firm*—Oyen Wiggs Green & Mutala

(57) ABSTRACT

A flexographic press of conventional design is used to print on a container, with the container to be printed upon replacing the web and the impression roll of the conventional press. In order to maintain the registration between the print stations, the container is placed into a carrier and stays registered to the carrier until all colors are printed. The carrier is moved between the different print stations and is registered to each print station independently. All print stations are set up to print in exactly the same place relative to the carrier, thus registration is achieved.

21 Claims, 7 Drawing Sheets

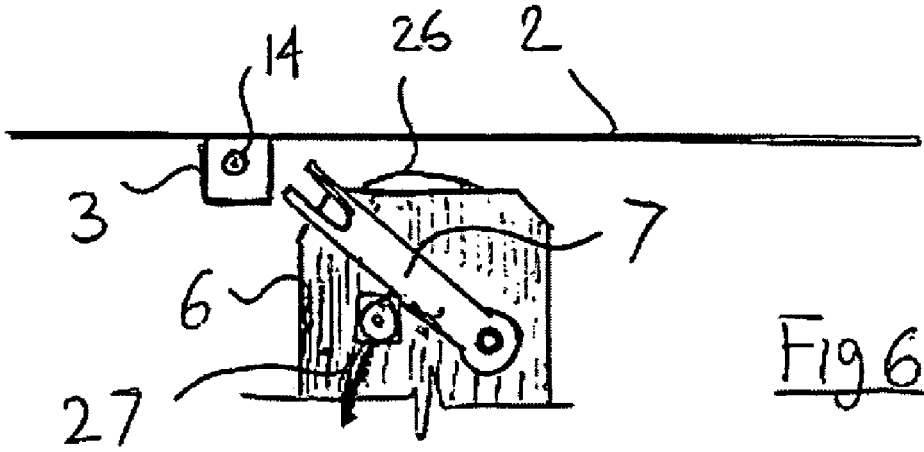
Fig 6-a
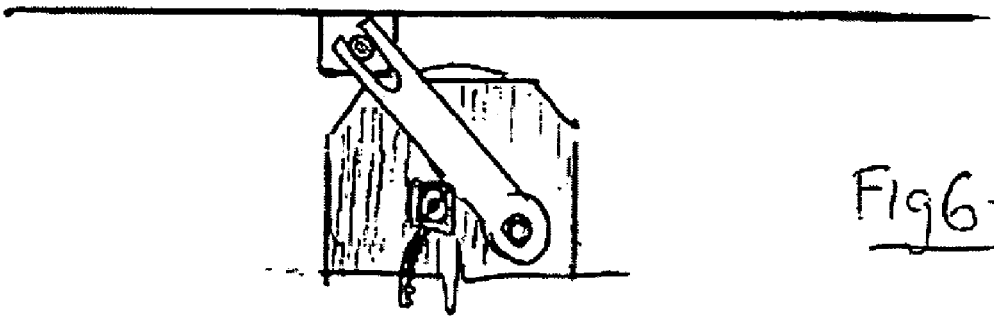
Fig 6-b
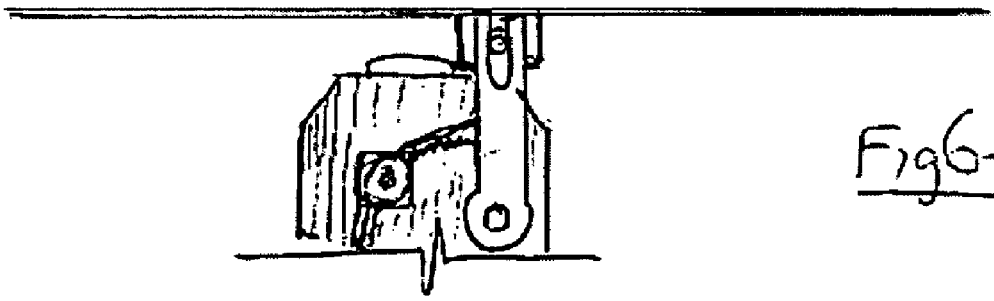
Fig 6-c
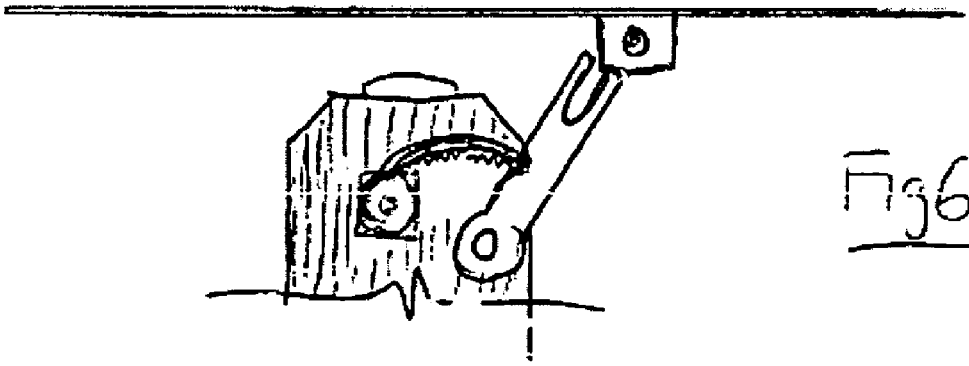
Fig 6-d

FLEXOGRAPHIC PRINTING ON CONTAINERS

FIELD OF THE INVENTION

The invention pertains to printing and more specifically to a method of directly printing multi-color images on containers such as bottles and cans.

BACKGROUND OF THE INVENTION

When printing multi-color images, accurate registration is required between colors. Since most containers have neither accurate reference features nor stiffness, it is difficult to print multi-color images on them. Such printing normally requires multiple printing units (one for each color) and registration is difficult to maintain when a container is transferred between successive print units. For this reason most color images on bottles are done by applying a pre-printed label to the bottle, increasing production costs over direct printing. In some cases, such as when printing on drinking cups or unfilled cans, a mandrel may be inserted into the container to achieve stiffness and registration (see for example U.S. Pat. Nos. 5,193,456 and 3,661,282), but, in the great majority of cases, the insertion of a mandrel to fill the container and allow registration is not possible at all, as it requires an opening at least as large as the largest cross-section.

The flexographic printing process is an ideal process for printing on thin-walled containers as it requires almost no pressure, so a method of utilizing flexographic printing on containers is highly desirable. A typical flexographic press comprises an ink supply (also referred to as an "ink fountain"), a metering roll in contact with the ink supply and transferring an accurately metered amount of ink to the plate (which is mounted on a plate cylinder), a material to be printed, usually in the form of a web, and an impression cylinder used to support the web. The most common form of metering roll is known as an anilox roll, which is a hard cylinder engraved with a continuous pattern of small pits. The excess ink is removed by a doctor blade or a reverse roll, leaving ink only in the recessed areas. The flexographic plate operates in a manner similar to the common rubber stamp: the elevated areas are inked and this ink is transferred to the web. The plate is usually mounted on a thin layer of cushioning foam.

It is an object of the invention to allow direct flexographic printing of monochrome and color images directly onto containers such as plastic and glass bottles, cans, cups, jars, and the like. It is a further object to address the registration problem in a manner compatible with present flexographic press design.

SUMMARY OF THE INVENTION

The present invention utilizes flexographic presses of conventional design, with the container to be printed replacing the web and the impression roll. In order to maintain registration between the print stations, the container is placed into a carrier and registration with the carrier is maintained until all of the colors are printed. The carrier is moved between the different print stations and is registered to each print station independently. All print stations are set up to print in exactly the same place relative to the carrier, thereby ensuring registration. Because of the slight shape variations between containers (even among ones from the same batch) a thicker and softer cushioning foam is used. In order to automate the process, a number of such carriers can be mounted on a conveyor belt, which moves the carriers from one print station to the next.

Registration may be performed while both the conveyor belt and the press are in operation, thus eliminating the need to stop and register. Performing the registration while in motion greatly increases throughput. The carriers are designed such that the bottles can be clamped and released (after printing is completed) while the carriers are in motion. This allows a high throughput continuous process, which is desirable for such high volume items as cans and bottles. The present invention can print on any shape of container that a regular label can be used on, such as, but not limited to, cylindrical, oval, conical and conical with oval cross section.

The invention and its objectives will become more clear by studying the preferred implementation in conjunction with the drawings.

BRIEF DESCRIPTION OF THE DRAWINGS

FIG. 6*a*, FIG. 6*b*, FIG. 6*c* and FIG. 6*d* show schematically the sequence of a carrier passing through a printing unit.

DETAILED DESCRIPTION OF THE PREFERRED EMBODIMENT

Figure 1:
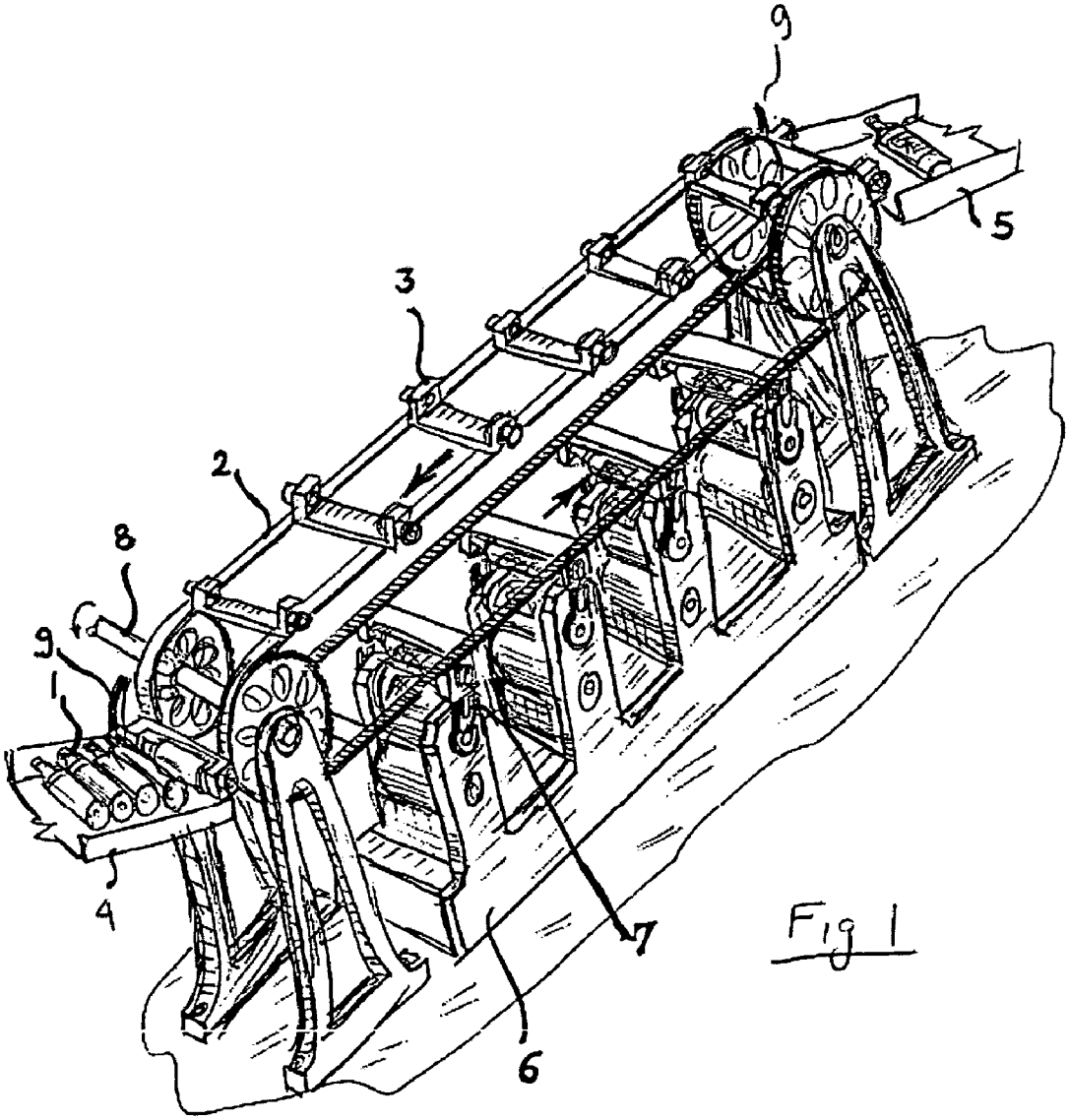
FIG. 1 is an isometric view of the complete printing system.

Referring to FIG. 1, a flexographic printing press 6 comprises a plurality of printing units. Each unit prints one color. Typically, the number of printing units on such a press is from 4 to 10 units. An endless conveyor belt 2 moves carriers 3 past the printing units. The containers 1 (bottles in the preferred embodiments) are supplied by an infeed tray 4 and are unloaded to an output tray 5. The conveyor belt 2 is powered by a shaft 8, which may be driven by a separate motor (not shown) or may be connected mechanically to the motor of press 6. If a separate motor is used, it must be synchronized to the speed of press 6 using the well-known principles of servo systems (also known as "shaftless" systems in printing presses).

At both the infeed and unload positions of conveyor belt 2, means 9 are provided to open carrier 3 in order to accept the bottle (at the infeed tray 4) and release the bottle (at output tray 5). The details of the mechanism 9 are discussed later with reference to FIG. 3 and FIG. 4. Each printing unit also has a registration means 7 to register the carrier 3 to the printing unit, and thereby to the printing plate mounted on the printing cylinder of the printing unit as the carrier 3 passes through it. The cylinder and plate are described below in more detail with reference to FIG. 5 and FIG. 7.

Figure 2:
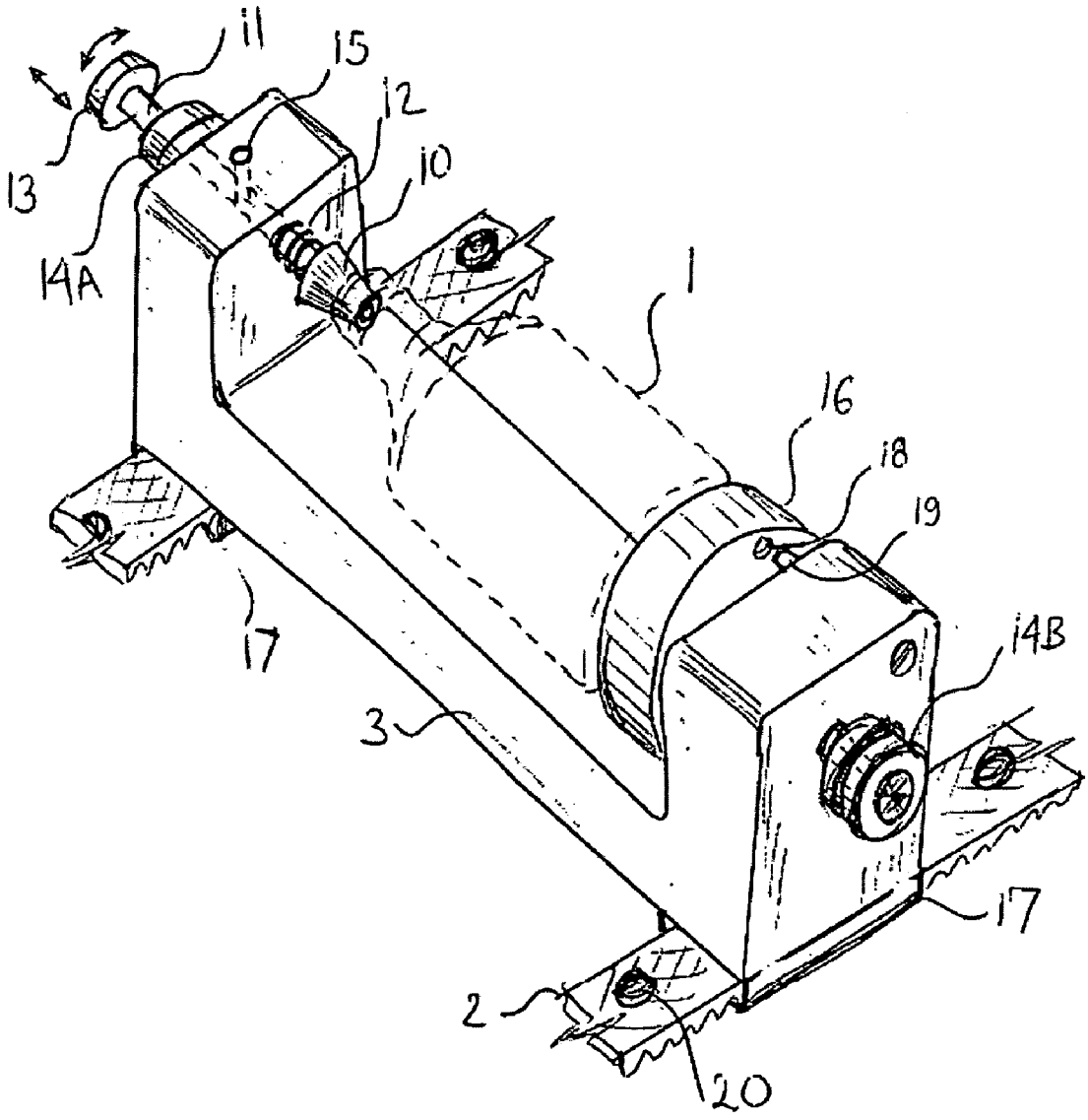
FIG. 2 is an isometric view of the carrier.

Referring to FIG. 2, the preferred embodiment of carrier 3 is shown. Carrier 3 is loosely attached to conveyor belt 2 via guides 17. Guides 17 allow some slippage between the carrier 3 and the conveyor belt 2, in order for carrier 3 to be able to align itself with each print unit. A stop 20 limits the range over which carrier 3 can move relative to belt 2. An alternate embodiment uses an elastic attachment, for example a spring, to attach carrier 3 to conveyor belt 2. The bottle 1 is held from two of its ends, similar to a workpiece held in a lathe. At one end a chuck 16 is shaped to fit the bottle; at the other end a tapered plug 10 fits into the opening of the bottle and is held there by the force of a spring 12. Shaft 11 can be retracted by pulling on a ball bearing 13. When shaft 11 is retracted, bottle 1 can be inserted and removed. Ball bearings 14A and 14B are used to align the carrier to the printing unit (to be discussed later). In this detailed description the letters A and B refer respectively to the left hand and right hand side of press 6, in the orientation shown in FIG. 1. In some cases, for example when printing on thin walled containers, it is desirable to pressurize the inside of the container via an air hole 15.

Figure 3:
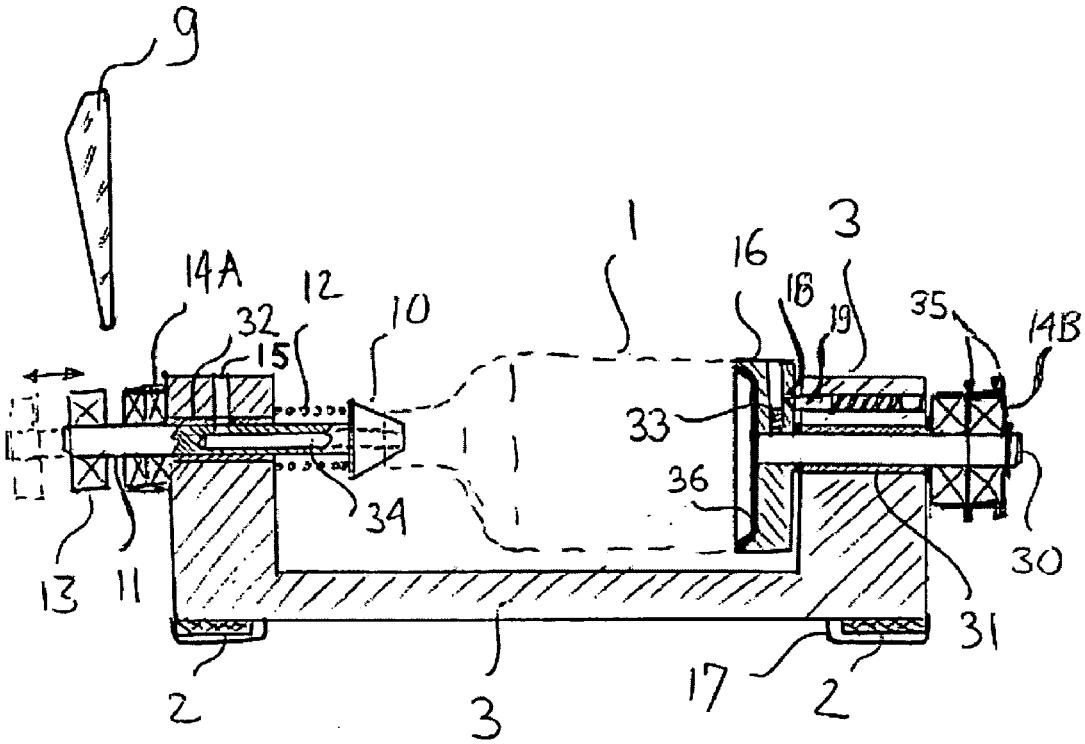
FIG. 3 is a cross section of the carrier.
Figure 4:
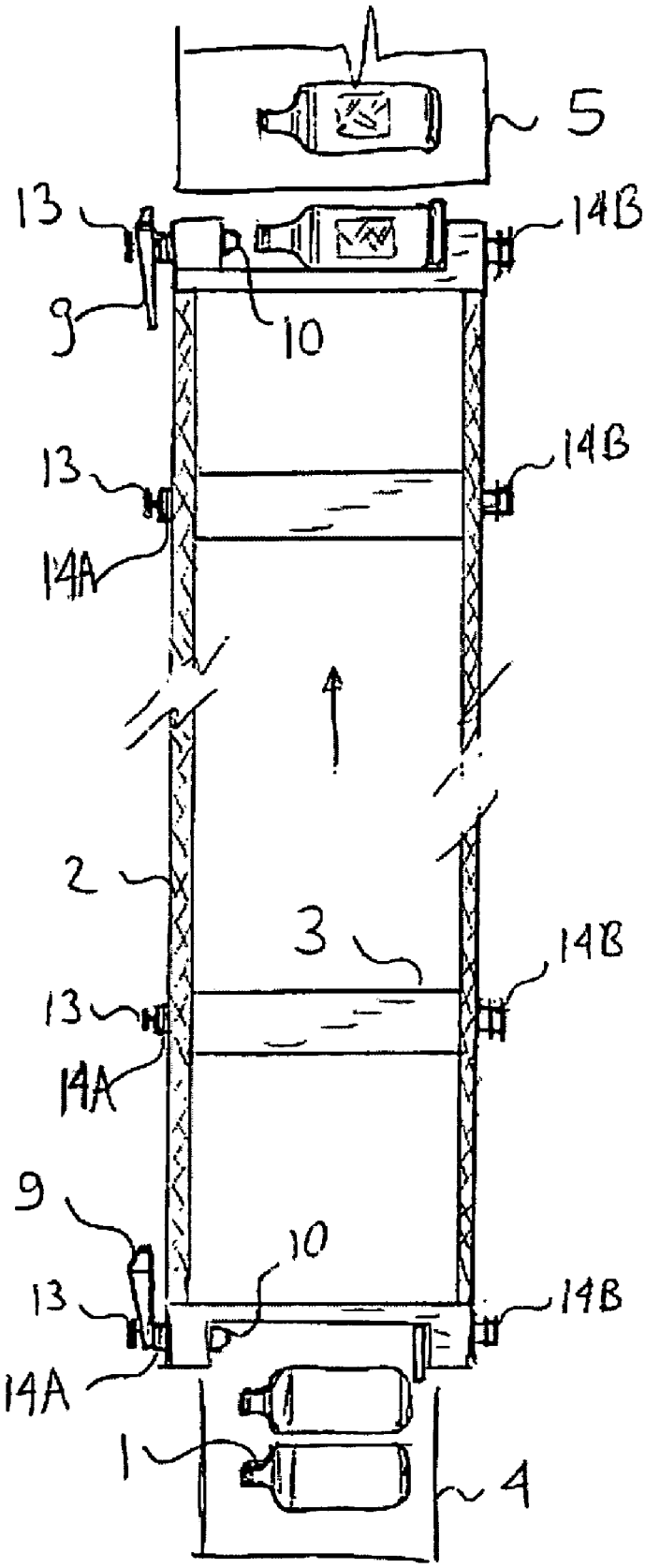
FIG. 4 is a top view of the conveyor belt system, showing the method of loading and unloading the bottles from the carriers.

Referring now to FIG. 2 and FIG. 3, it can be seen that air hole 15 is connected to a hole in shaft 11 and plug 10. This allows air to be fed into bottle 1 for the short duration it is in contact with the printing unit. The mechanism to retract shaft 11 can be as simple as a wedge 9, which is placed in the path of carrier 3. As bearing 13 rolls against the edge of wedge 9, shaft 11 is pulled out. FIG. 4 shows the placement of such wedges 9 at both the infeed position 4 and unload position 5 of conveyor belt 2.

Returning to FIG. 2 and FIG. 3, it is obvious that different sizes and shapes of chuck 16 and plug 10 are needed for each size and shape of bottle. When using cans, the shape of plug 10 is similar to chuck 16. Means of removing chuck 16 are shown schematically as a setscrew 33. It has been found that the pressure of spring 12 is sufficient to keep bottle 1 in place during printing if the inside of chuck 16 is coated with a high friction material 36 such as silicone rubber or polyurethane rubber. Shafts 11 and 30 can rotate freely in bearings 32 and 31. In some applications, for example when printing on rectangular or oval bottles, bottle 1 should be prevented from rotating during printing. In some other applications, such as printing all around a cylindrical bottles, bottle 1 may be allowed to rotates but should return to a known orientation. This is accomplished via detent 18 and spring loaded pin 19. When printing covers the full circumference, chuck 16 will return to the detent position.

If printing is not required to cover the full circumference of a container, the printing plate is continued as a narrow non-inked strip in order to complete the rotation of the battle. More details on this subject are provided later in this disclosure. It should be noted that registration is required in both the circumferential direction (achieved by detent 18) and in the axial direction. Therefore, shaft 30 should be free from any axial play and the shoulders 35 of bearing 14B should fit the mating part (item 7B in FIG. 5) accurately. In the preferred embodiment belt 2 is a timing belt, bearings 13 and 14 are shielded ball bearings, bearings 31 and 32 are sintered bronze bushings, and carrier body 3 may be made of aluminum.

Figure 5:
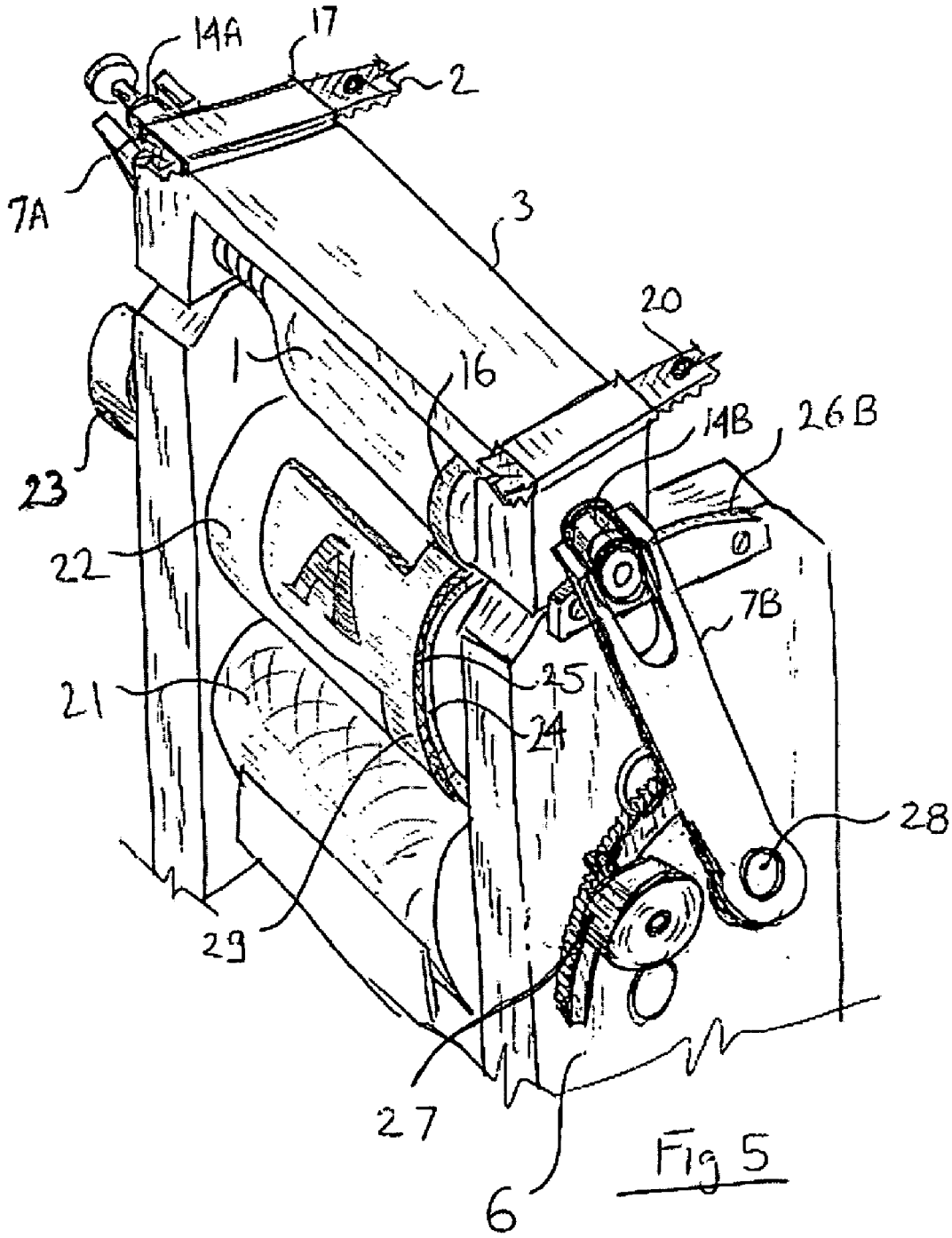
FIG. 5 is an isometric view of the mechanism registering the carrier to a printing unit.

Referring now to FIG. 5, the mechanism shown has four functions:

1. Locate carrier 3 axially relative to printing plate 25. In this disclosure the axial direction is the direction of the axis of the bottle and of the cylinders.
2. Locate axis of bottle 1 parallel to the axis of printing cylinder 22.
3. Bring bottle 1 in contact with printing plate 25 at the correct circumferential point and ensure contact is sufficient for a complete rotation (for round bottles or cans).
4. Locate bottle 1 in the vertical direction to achieve the correct impression pressure via the correct compression of the foam backing the printing plate.

As conveyor belt 2 brings carrier 3 closer to printing press 6, arms 7A and 7B engage bearings 14A and 14B of the carrier. It is desirable to make arm 7B with a tapered tip, i.e. the thickness of the arm in the axial direction at the tip is less than the thickness at the position of normal engagement during printing. This helps with guiding arm 7B between the shoulders 35 of bearing 7B (shown in FIG. 3). The sequence of the engagement between bearings 14 and arm 7 is shown in FIG. 6*a* to 6*d*.

As shown in FIG. 5, arms 7A and 7B are coupled by a sturdy shaft 28 which runs parallel to the axis of the plate cylinder 22. Arms 7A and 7B therefore force the axis of the bottle 1 to be parallel to the axis of the plate cylinder 22. The elevation of carrier 3 during printing, and therefore the compression of foam layer 24 under plate 25, is determined by guide plates 26A and 26B (see also FIG. 7 for greater clarity). Guide plates 26 should be adjusted for an average compression of about 0.5 mm in foam layer 24. Layer 24 is made of dense closed cell foam, about 2–4 mm in thickness. The standard foam tape used for mounting flexographic printing plates is too thin for this purpose (but can be used to attach plate 25 to foam layer 24). It has been found that, under these conditions, very good dot reproduction (5%–95%) of fine screens (up to 80/cm) may be achieved even with a bottle run-out of 1 mm. Obviously the compression of foam 24 should be such as to allow contact with the bottle even at the worst run-out to be encountered. Too much compression degrades print quality, too little compression may cause loss of contact. The optimum elevation of guide plate 26 is best found by carefully experimenting during a trial run.

In order to achieve circumferential registration between the bottle and the plate and between the image and the index position of the bottle, the angular position of plate cylinder 22 is measured by shaft encoder 23. At the correct position of cylinder 22, actuators 27 push carrier 3 into contact with plate cylinder 22. In the preferred embodiment actuator 27 is a servomotor, coupled to arm 7B by a gear. An alternative coupling is via a timing belt. Because actuators 27 may momentarily stop carrier 3 from moving while conveyor belt 2 keeps moving, some relative motion should be possible between carrier 3 and belt 2. In the preferred embodiment there is a sliding fit, which may be a friction fit, between them. Note that bearing 14B is shaped to allow part of the bearing to ride on guide plate 26 while the other part engages arm 7B (see FIG. 3 and FIG. 7 for more detail). An alternative to using bearing 14B for axial register is to use a vertical guide plate to guide bearing 14B in the axial direction, similar to the guidance provided by plates 26 in the vertical direction. There should be only minimal play (i.e. gap) between arms 7A and 7B and bearings 14A and 148, as any play will cause mis-register.

When bottle 1 touches plate 25, it starts rotating because of friction (overcoming the detent action of detent 18 in FIG. 3). At the same time arms 7 move it slowly to the other side of plate cylinder 22 until bottle 1 stops touching plate 25. By adjusting the speed and amount of travel of arms 7, bottle 1 will complete one rotation. A slight variation (a few %) will not matter, as bottle 1 will be pulled into the reference position by the action of detent 18. The detent action of carrier 3 is also important when bottles are loaded at a specific orientation, in order to avoid printing on the seam or other defects. It is also clear that bottles can be loaded at a random orientation and additional hardware can be used to orient them to a reference position. This is common practice in current label applicators. Clearly the motion of arms 7 must be slower than the circumferential velocity of plate cylinder 22, otherwise bottle 1 will not complete a full rotation. In those cases where it is not desired to print the full circumference of the bottle, a "dummy" part of plate 29 is left to complete the rotation. This part is aligned with chuck 16 and is not inked by anilox roll 21, as its only function is to serve as a friction drive for bottle 1. Accidental inking, however, is not detrimental. Anilox roll 21 can be made narrower than plate cylinder 22 to avoid inking of strip 29. No further details of press 6 are given as the rest is conventional in construction and well known in the art of flexographic presses. The details of connecting an output of shaft encoder 23 to the servomotor actuator 27 are not shown, as they follow standard procedures of servo systems well known in the art of press design.

Figure 7:
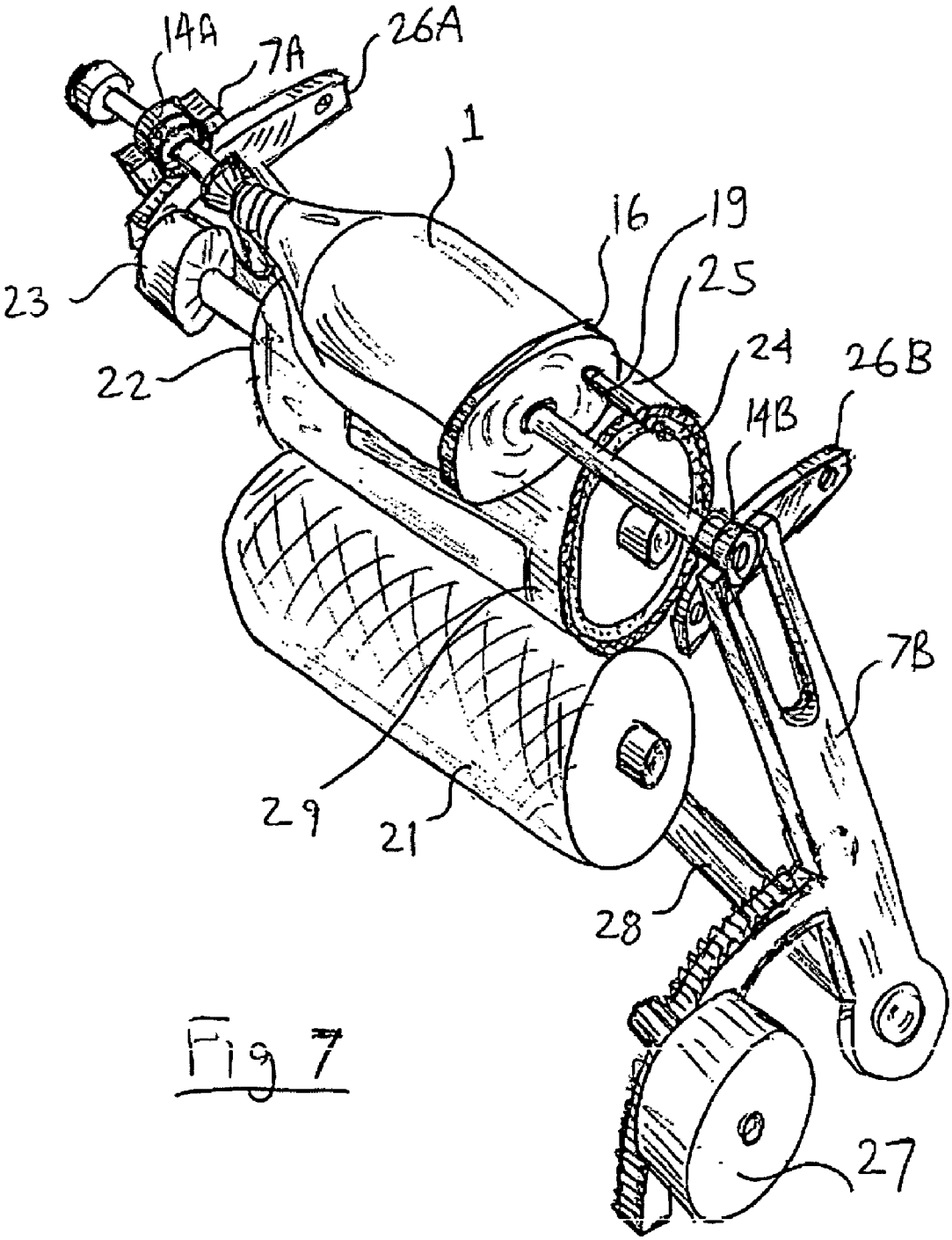
FIG. 7 is an isometric view of printing on an oval bottle, with the sidewalls of the printing unit removed for clarity.

FIG. 7 shows printing on oval or rectangular bottles. For clarity the side walls of the press are omitted. For such bottle shapes it is preferable to prevent bottle 1 from rotating by using a firmer pressure of pin 19 against the detent hole in chuck 16. Bottle 1 is moved into printing position by arm 7 and actuator 27, but from the point the plate touches the bottle, actuator 27 should not force bottle 1 across the plate. Bottle 1 should move at a velocity determined by the plate cylinder. This is required as the bottle is no longer free to rotate to find the correct circumferential velocity. This condition can be achieved by disconnecting actuator 27 at this point, or by programming a velocity profile in actuator 27 to match the traverse speed imparted by the plate cylinder. As in FIG. 5, a section of "dummy plate" may be left to engage the bottle before printing starts and to push it past the plate cylinder at the end of the printed area. It is desirable, but not mandatory, not to ink this "dummy" section as it comes into contact with the chuck.

To print the other side of an oval bottle, a second print station may be used, or the bottle may be raised and rotated 180 degrees within one print cycle. The latter option requires the use of a more complex guide plate 26.

A more complex case arises when the bottle is tapered, or both tapered and oval. In such a case, it is best to use a tapered plate cylinder 22 that matches the taper of the bottle. Such a tapered plate cylinder will have some slippage relative to the anilox roll 21, but such slippage is not detrimental to image quality. On the other hand, any slippage of the plate relative to the bottle will ruin the printed image. In the most generic case, each of arms 7A and 7B should have its own actuator 27 rather than a coupling shaft 28. This allows handling of bottles with a high degree of taper or taper and ovality, as each end of the bottle can be moved at a different speed to maintain line contact with the plate 25.

The preferred embodiment shown uses mainly mechanical means to bring the container into registration with the plate. It is well known that any mechanical linkage such as a gear, lever, clutch or the like can be replaced by an electronic linkage performing the same function. Many modern flexographic presses no longer use gears to synchronize the cylinders; instead, they rely on electronic servo systems. Such presses are sold under the general term "shaftless". It is obvious to one skilled in the art that the mechanical components in the preferred embodiment can be replaced with their electronic equivalents (or any other equivalent system, such as hydraulic). It is also clear that all the functions that are shown as purely mechanical in the preferred embodiment described here can be performed with servo systems; thus items such as guide plates, detents, friction drive and the like can all be done by servo systems if so desired.

The current description should therefore be read in the broadest sense. For example, when a mechanical actuator such as a lever is shown, it is obvious that it can be replaced by an electrical actuator such as a solenoid or a motor as well as by a hydraulic cylinder. Similarly, while an endless belt type conveyor system is shown here to bring the carriers to the press, it is clear that any other method of moving the carriers between the print units can be utilized. Examples of some well-known alternate methods are:

1. Robotics arms to transport carriers between print units.
2. A rigid arrangement of carriers at the periphery of a large wheel.
3. Carriers linked together to form a linked belt (similar to a bicycle chain).

There have thus been outlined the important features of the invention in order that it may be better understood, and in order that the present contribution to the art may be better appreciated. Those skilled in the art will appreciate that the conception on which this disclosure is based may readily be utilized as a basis for the design of other methods and apparatus for carrying out the several purposes of the invention. It is most important, therefore, that this disclosure be regarded as including such equivalent methods and apparatus as do not depart from the spirit and scope of the invention.

What is claimed is:

1. A method for flexographic printing on a container using a printing press comprising at least one flexographic printing unit having a plate mounted on a rotatable plate support, the method comprising:

mounting the container in a carrier by gripping two ends of the container, transporting the carrier to a first printing unit of the at least one printing units, engaging the carrier with an actuator mechanism associated with the first printing unit and holding the container in a desired orientation, monitoring an angular position of the plate cylinder, causing the actuator mechanism to bring the container into engagement with a flexographic plate on the plate cylinder when the monitoring determines that the plate support is at a desired angular position, and subsequently releasing the container from the carrier.

2. A method according to claim 1, wherein the container is one of a bottle and a can.

3. A method according to claim 1 wherein the container is non-cylindrical.

4. A method according to claim 3 comprising holding the container fixed in the desired orientation while the container is in engagement with the flexographic plate.

5. A method according to claim 4 wherein the non-cylindrical container is oval in cross section.

6. A method according to claim 4 wherein the non-cylindrical container is rectangular in cross section.

7. A method according to claim 3 comprising, after bringing the container into engagement with the flexographic plate, holding the container fixed in the desired orientation until a first side of the container has been printed on, subsequently disengaging the container from the flexographic plate, rotating the container through 180 degrees and bringing the container back into engagement with the flexographic plate.

8. A method according to claim 3 wherein the non-cylindrical container is tapered.

9. A method according to claim 8 comprising operating the actuator mechanism to move first and second opposing ends of the carrier past the plate support at different speeds while the container is engaged with the plate.

10. A method according to claim 9 wherein the plate support has a taper matching a taper of the container.

11. A method according to claim 10 comprising both rotating the container relative to the carrier and moving the container past the plate support while the container is engaged with the plate.

12. A method according to claim 11 wherein rotating the container comprises, at least in part, engaging a circumferentially-extending strip of the plate with a rotatable element of the carrier.

13. A method according to claim 12 wherein the circumferentially-extending strip of the plate is non-inked.

14. A method according to claim 11 wherein the non-cylindrical container is both oval and tapered.

15. A method according to claim 1 wherein the carrier is coupled to a conveyor, the method comprises transporting the carrier to the first printing unit by moving the carrier in a longitudinal direction of motion of the conveyor, and the method comprises allowing the carrier to move in the longitudinal direction relative to the conveyor while the container is engaged with the plate.

16. A method according to claim 15 wherein the carrier is slidably connected to the conveyor by guides and allowing the carrier to move in the longitudinal direction comprises allowing the guides to slip relative to the conveyor.

17. A method according to claim 1 wherein the actuator mechanism comprises first and second pivotally-mounted arms and engaging the carrier with the actuator mechanism comprises slidably engaging first and second ends of the carrier with the first and second arms respectively.

18. A method according to claim 17 wherein the container is tapered and the method comprises pivoting the first and second arms of the actuator mechanism at different rates after engaging the container with the plate.

19. A method according to claim 17 wherein the first printing unit comprises a layer or foam in the range of 2 mm to 4 mm thick underlying the flexographic plate and the method comprises compressing the layer of foam by about ½ mm.

20. A method according to claim 1 comprising transporting the carrier to the first printing unit by way of a robotic arm.

21. A method according to claim 1 comprising establishing an elevated pressure within an interior of the container by injecting air into the container through a passage in the carrier.

* * * * *